United States Patent [19]

Frye

[11] 4,319,442

[45] Mar. 16, 1982

[54] CONTINUOUS ON MACHINE REAM CARTONING

[75] Inventor: Kenneth G. Frye, South Egremont, Mass.

[73] Assignee: Beloit Corporation, Beloit, Wis.

[21] Appl. No.: 113,721

[22] Filed: Jan. 21, 1980

[51] Int. Cl.[3] ..... B65B 35/50

[52] U.S. Cl. ..... 53/447; 53/475; 53/535

[58] Field of Search ..... 53/443, 475, 473, 535, 53/540, 447, 500; 414/45, 50, 36, 91; 271/218

[56] References Cited

U.S. PATENT DOCUMENTS

| | | | |
|---|---|---|---|
| 2,767,534 | 10/1956 | Nydegger et al. | 53/500 |
| 2,960,243 | 11/1960 | Beaulieu | 214/6 |
| 3,959,951 | 6/1976 | Paules | 53/535 X |
| 4,138,836 | 2/1979 | Crowe et al. | 53/500 |
| 4,144,694 | 3/1979 | Stapp et al. | 53/535 X |
| 4,162,649 | 7/1979 | Thornton | 271/218 X |

FOREIGN PATENT DOCUMENTS

| | | | |
|---|---|---|---|
| 1491475 | 11/1977 | United Kingdom | 53/500 |

*Primary Examiner*—James F. Coan

*Attorney, Agent, or Firm*—Hill, Van Santen, Steadman, Chiara & Simpson

[57] ABSTRACT

The instant invention concerns a cartoning assembly which operates in conjunction with a sheet stacker to pile sheets directly in their carton. The assembly loads a three-sided carton having an open top into the stacker and supports the carton there such that sheets accumulate in the carton. After a predetermined number of sheets have been piled in the carton, succeeding sheets piling into the stacker are segregated and separately supported away from the predetermined pile. The carton is then transferred to a discharge conveyor for processing and lidding. Meanwhile, a further carton is loaded into the stacker and supported beneath the succeeding pile. The succeeding pile is then deposited into the further carton. The further carton is supported in the stacker until the predetermined number of sheets accumulate and the process repeats.

18 Claims, 4 Drawing Figures

CONTINUOUS ON MACHINE REAM CARTONING

BACKGROUND OF THE INVENTION

1. Field of the Invention

This invention relates to a method and means for cartoning sheets at the same time sheet piles are being formed in a stack.

2. Description of the Prior Art

The conventional paper-making assembly line has heretofore required a separate station for ream cartoning. Typically, paper sheets or clips issue from a sheeting machine which shears the sheets from a continuous paper web. The sheets are advanced seriatim, usually along a delivery conveyor system, to a stacking station wherein the sheets are piled into reams up against a backstop in a stacker. After a predetermined ream number of sheets have accumulated in the stacker, the pile is transported, usually by conveyor, to a further station for cartoning. At the cartoning station, manpower has customarily been required to remove the ream from the conveyor, position the ream in a carton, set the carton for processing, and put the carton on its way to be processed. The additional handling required at the typical cartoning station results in a loss of production time and requires extra manpower on the papermaking assembly line. The additional handling may often result in paper being damaged which interrupts production efficiency.

The present invention circumvents the necessity of providing a separate station for cartoning and, so, eliminates the extra manpower and additional handling incident to such a separate station. In this manner, the present invention economizes the paper-making production line.

SUMMARY OF THE INVENTION

The present invention is drawn to a cartoning assembly which operates in conjunction with a sheet stacker to allow sheets to collect directly in their carton without stopping or decelerating the sheeting and stacking operations.

The cartoning assembly is comprised of a carton, means for loading the carton in the stacker, means supporting the carton in the stacker such that sheets being delivered and piled in the stacker accumulate in the carton, and various mechanisms enabling the carton to be transported away from the stacker after a pile having a predetermined number of sheets has formed in the carton. Cartons to be used by the assembly are three-sided, having an open top and a front sidewall, or lead edge, which is folded under the bottom of the carton. A carton is loaded into the stacker by means which insert the carton beneath a stacker backstop so that the back sidewall, or trailing edge, of the carton abuts up against the exterior surface of the backstop. The carton is supported in the stacker on a series of columns so that sheets being delivered and piled in the stacker accumulate in the carton. The mechanisms which transport the carton when the desired pile has accumulated include means for segregating succeeding sheets accumulating in the stacker from the desired pile, means for separately supporting the succeeding accumulation of sheets away from the predetermined pile, discharge conveyor means, and means moving the carton supporting means from the stacker to the discharge conveying means such that the carton may be borne away for further processing and lidding. To segregate a predetermined pile from succeeding sheets, an interrupter device intercedes a short distance over the upstream end of the predetermined pile to create a cleft between successive sheets and the top of the predetermined pile. Following the firing of the interrupter, a divider means is inserted into the cleft. The divider means consists of a series of upper and lower spear members having a gap therebetween. The upper spear members serve to separately support the succeeding sheet accumulations apart from the predetermined pile, while the lower spear members pass over the top of the predetermined pile to compact it in the carton. The interrupter withdraws as the divider means is inserted in the cleft. As succeeding sheets accumulate in a pile on the upper spear members, means for moving the carton support columns serve to advance the carton having the predetermined pile formed therein to a discharge conveying means. The discharge conveyor is comprised of a series spaced-apart ribbons between which extend the carton support columns. The means for moving the carton supporting means retract the support means beneath the upper surface of the discharge ribbons so as to deposit the carton onto the ribbons. Hence, the desired pile is already in the carton and able to pass directly from the stacker to the final processing and lidding stations without the need for a cartoning station. As the carton having the predetermined pile is being advanced to the discharge conveying means, a jogger means abuts the predetermined pile in the carton so that the pile is in contact with the back sidewall of the carton.

During the time the carton having the predetermined pile is being transported to the discharge conveyor means, a further carton is loaded into the stacker beneath the backstop such that the folded lead edge of the further carton passes into the gap between the upper and lower spear members of the divider means. The new carton is carried to the stacker on a truck means which is linearly moveable and has carrying surfaces which intermesh with the lower spear members. The further carton is inserted into the stacker through special slots in the backstop through which the sidewalls of the further carton pass. The new cartons enter the stacker at a level below the upper surfaces of the lower spear members such that the lower spear members assume support for the further carton in the stacker. When the further carton has been fully loaded into the stacker, the truck withdraws leaving the further carton to be supported in the stacker on the lower spear members.

After the carton having the predetermined pile has been deposited on the discharge conveyor means, the carton support columns are returned to the stacker. The support columns intermesh with the lower spear members and are driven such that the columns engage the bottom of the further carton and lift the further carton slightly over and off the lower spear members. The dividing means then withdraw from the stacker leaving the further carton to be supported solely by the carton supporting means. As the spears withdraw, the succeeding sheet accumulation formed on the upper spear member is deposited in the further carton. After the dividing means have withdrawn from the stacker, further sheets continue to collect in the carton until the predetermined number is again reached and the process repeats.

The spear members consist of continuous lengths of tape extending in an elongated loop such that they pass in a relatively no skid or zero speed manner in and out of the stacker and over sheet and carton surfaces.

The cartoning assembly is designed to operate in a series of stacker stations at the same time. For this purpose, members of the cartoning assembly are formed in long rows arranged to transgress a series of stackers. Each row of members operates in unison, thereby eliminating the need for cartoning stations along each assembly line represented by a stacker.

DESCRIPTION OF THE PREFERRED EMBODIMENT

The preferred embodiment is drawn to the collecting and cartoning of predetermined stacks or reams of paper sheets. However, the present invention could be used for stacking and cartoning other sheet material, such as, for example, board or cardboard.

Figure 1:
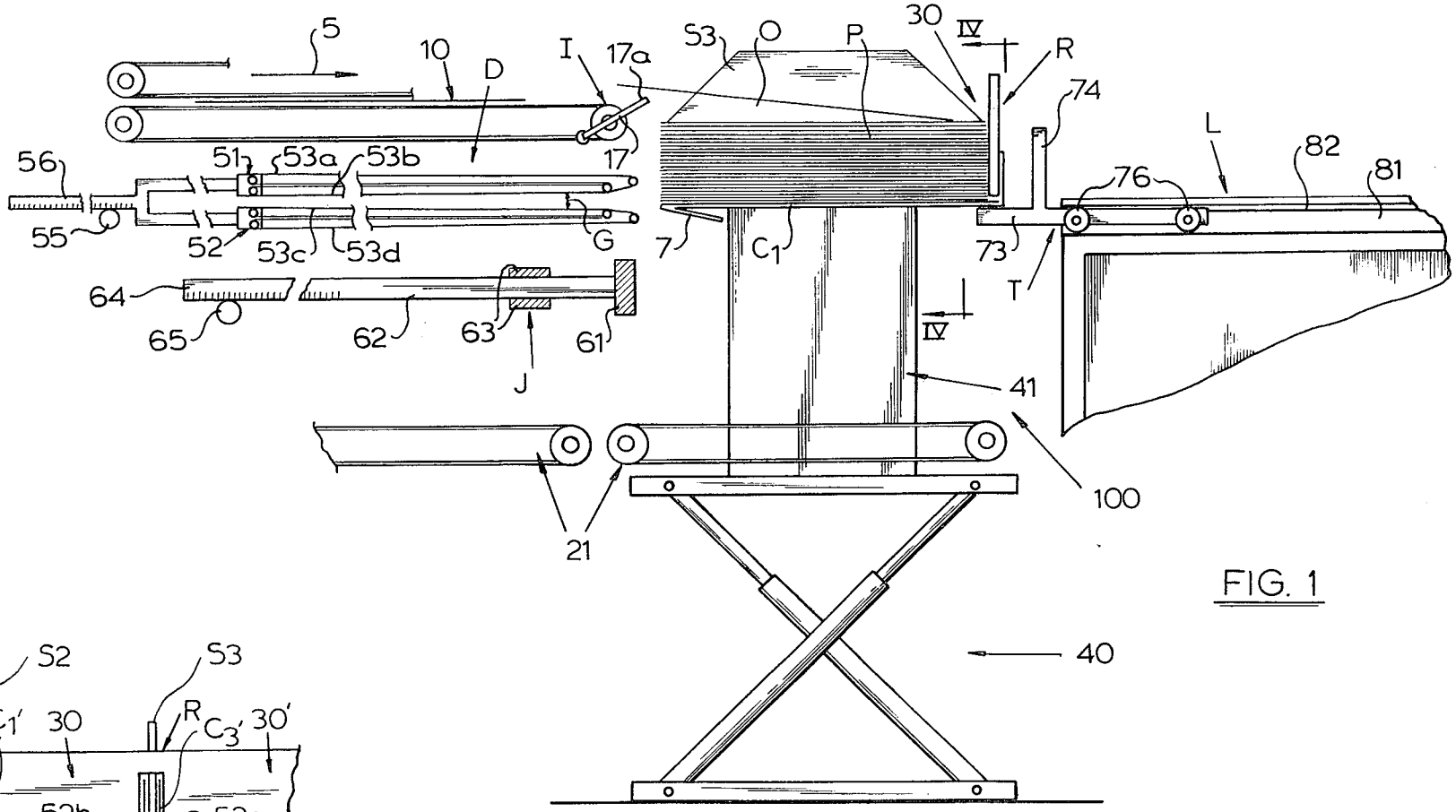
FIG. 1 is a partly schematic side sectional elevation of the cartoning assembly of the present invention in a first stage of operation.

As shown in FIG. 1, paper sheets 10 are transported seriatum in the direction of arrow 5 on delivery conveyor means 20. The sheets 10 are successively piled in a stacker 30 by means well known in the art, for example, such as described in U.S. Pat. No. 4,162,649 entitled "Sheet Stack Divider," issued to John N. Thornton on July 31, 1979. Depending on the kind of sheet delivery device used, a successive sheet is either projected or carried in a substantially horizontal path onto the top of a pile. Each sheet 10 is deposited onto the pile so as to jog against a reference or backstop R.

A cartoning assembly 100 enables a sheet pile to accumulate in a carton $C_1$. The carton $C_1$ is a pre-formed unit having a bottom and sidewalls. However, it is a contemplation of the present invention that the front sidewall, or leading edge 7 of the carton $C_1$ be folded under while in the stacker as shown in FIG. 1 such that carton $C_1$ is a three-sided container for the purposes of the cartoning assembly 100. Carton support means 41 in the form of a series of spaced-apart columns are provided to support the carton $C_1$ in the stacker 30. The carton $C_1$ is positioned adjacent the end of the delivery conveyor 20 such that the leading edge 7 faces the downstream end of the delivery conveyor 20. The back sidewall 8 of the carton $C_1$ abuts the outer wall surface of the backstop R so that sheets 10 jog against the inner wall surface of the backstop R inside the carton $C_1$. On either side of the carton $C_1$ there are separation, or partition walls, such as $S_3$ shown in FIG. 1, which serve to guide the carton $C_1$ in the stacker.

When the desired ream P has accumulated in the carton $C_1$, the cartoning assembly serves to transport the carton $C_1$ away from the stacker for final processing and lidding. For this purpose, the support means 41 is driven by a lift table device 40 such that the support columns 41 may reciprocate vertically in the stacker 30. Lift table 40 is operated in a fashion known in the art so as to descend at the same rate as the growth of sheets in the stacker 30, thereby maintaining a constant delivery height at which sheet delivery means 20 may deposit sheets 10 into the stacker 30. After a predetermined ream has formed in the stacker 30, the lift table means 40 moves the support means 41 to a discharge position beneath the stacker 30 whereupon the carton $C_1$ is borne away for the further processing and lidding. After discharging the carton $C_1$ the support means 41 are driven rapidly upward by the lift table 40 to once again bear a carton in the stacker 30. Although the instant invention is not limited to any particular means, one example of an arrangement which operates the lift table 40 and support means 41 in the described manner is set forth in the U.S. Pat. No. 4,162,649 referred to above.

By means of devices known in the art, a signal can be generated which indicates when a predetermined number of sheets 10 have been delivered into the stacker 30. The instant invention is not limited to any particular means; however, one manner in which such a signal could be generated is described in the U.S. Pat. No. 4,162,649 referred to above. After a predetermined fixed number of sheets 10 have accumulated in the carton $C_1$, the signal is used to actuate an interrupter device I, which initiates the process by which the ream P is transported from the stacker 30 by segregating the ream P from succeeding sheet accumulations.

The interrupter device I is described in commonly assigned U.S. Patent Application Ser. No. 162,136, filed June 23, 1980, on behalf of Arthur T. Karis and entitled "Continuous Sheet Collection and Discharge System." Generally, the interrupter I consists of a plate-like member 17 supported on a cam track means beneath the downstream end of the delivery conveyor 20 such that the plate 17 extends adjacent to the upstream end of the stacker 30. The plate 17 is driven along its cam track by means of an air piston-motor arrangement controlled by a solenoid operated valve. Upon actuation in response to the signal indicating the predetermined number of sheets has accumulated in the carton $C_1$, the downstream end 17*a* of the interrupter plate 17 is impelled between succeeding sheets 10 and the top of the ream pile P as shown in FIG. 1. During this firing of the interrupter I, the downstream end 17*a* intercedes a short distance over the upstream end of the pile P to create a cleft, or opening, O between the bottom of an accumulation of succeeding sheets 10 and the top of the ream P. The plate 17 descends to a point where it extends almost parallel with the top of the ream pile such that the area of the cleft O is greatly reduced. However, the cleft O then widens as the carton $C_1$ continues its descent on support columns 41. Thereafter, cleft O serves as a space into which a divider means D may enter to separately support the successive accumulation of sheets 10 being formed above the plate end 17*a*. After the divider means D enters into the cleft O, the interrupter plate 17 is returned to its original, non-interfering position adjacent the upstream end of the stacker 30.

The divider means D is located beneath the interrupter device I. The divider means D utilizes spear assemblies as described in commonly assigned U.S. Patent Application Ser. No. 162,136 referred to above. Generally, a spear assembly is formed with a pair of upper and lower continuous lengths of tape, each extending in a loop from one side of an anchor wall about anti-friction roller means to the other side of the anchor wall. Four rollers are utilized. These rollers are laterally spaced apart with an upper and lower roller at either end. An upper loop of tape is threaded about the upper rollers with its ends fixed on either side of an upper anchor wall. A lower loop of tape is threaded about the lower rollers with its ends fixed on either side of a lower anchor wall. The leftmost upper and lower rollers are positioned substantially even with each other; however, the rightmost upper and lower rollers are fixed in a staggered fasion with the upper roller positioned further most rightward giving a somewhat pointed leading edge to the spear. The rollers are mounted on shafts connected between side plates extending from a rack bar. The rack may be supported for reciprocal lateral movement by means of bearing guides. A reversible pinion means engages the rack bar to provide lateral movement of the spear. The spear is able to support an object along a planar side without disturbing the position of the object in that the tape loops provide zero speed contact with the planar surface of the object. In this manner, for example, a pile of paper sheets can be passed from a spear member without buckling or jogging of the stack.

Figure 2:
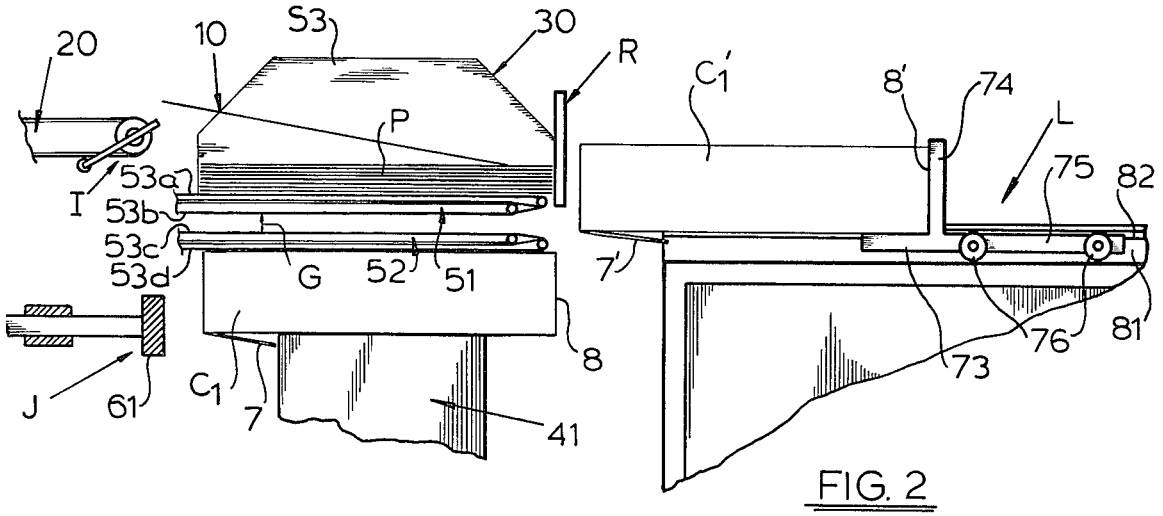
FIG. 2 is a partly schematic side sectional elevation of the cartoning assembly of the present invention in a second stage of operation.
Figure 3:
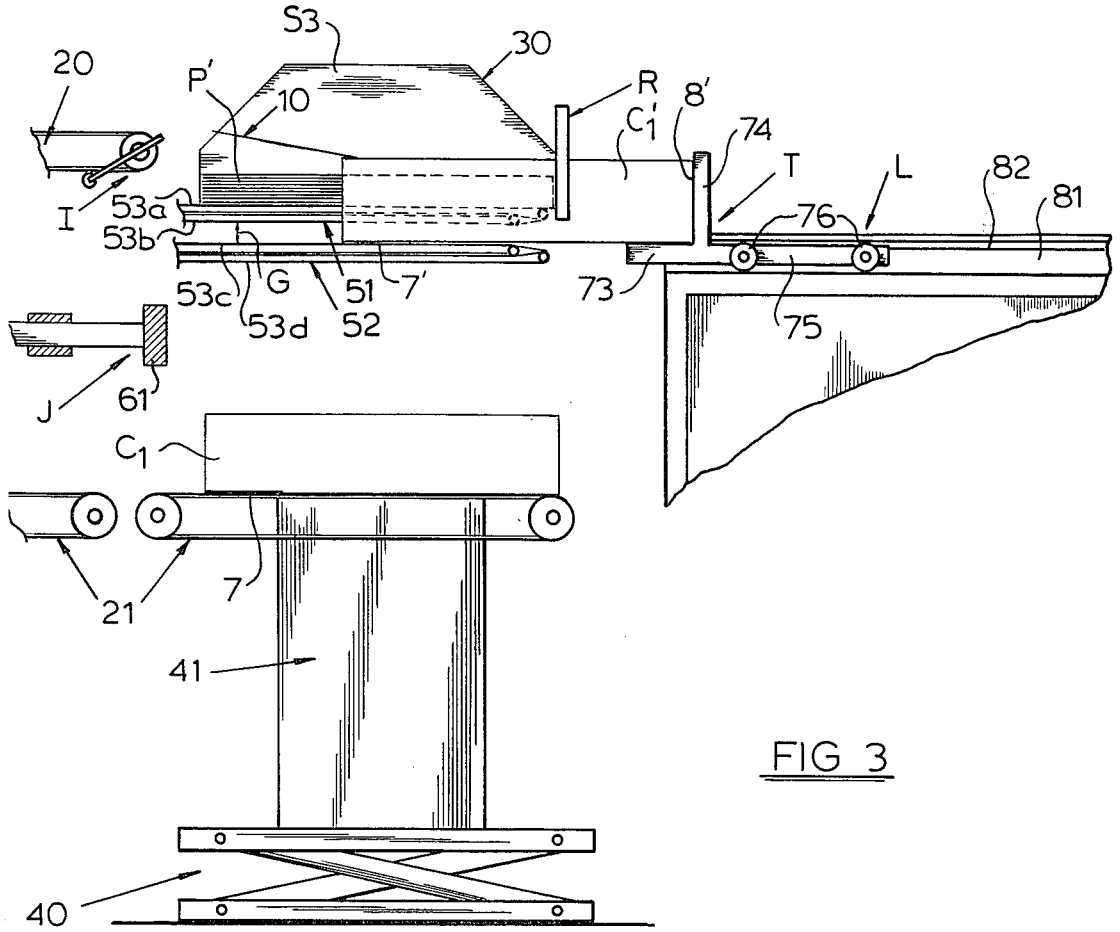
FIG. 3 is a partly schematic side sectional elevation of the cartoning assembly of the present invention in a third stage of operation.

For the purposes of the present invention the divider means D consists of a series of spaced-apart individual support means respectively comprising upper 51 and lower 52 spear assemblies as shown in FIGS. 1, 2, and 3. The spear assemblies 51 and 52 are formed as mirror images of each other. The tape surfaces which face each other are separated by a gap G. A single, reversible drive pinion 55 engages a common integral rack bar 56 to linearly actuate the divider means D, such that the upper, and lower spear assemblies 51 and 52 move in unison. Drive for the divider means D is actuated in response to movement of the interrupter means I.

As shown in FIG. 2, the divider D is extended into the cleft until the leading, or rightward, edges of the spears 51 and 52 are almost abutting the backstop R. Upon being inserted into the cleft O, and upper tape surface 53*a* of the upper tape loop in spear 51 serves to separately support the accumulating, successive pile P' and a lower tape surface 53*d* of the lower tape loop in spear 52 passes over the top of the finished, or ream, pile P in order to compact the pile P in its carton $C_1$. In this manner, the successive pile P' is supported and separated from the top of the ream pile P by the gap G between the spears 51 and 52.

After the divider D has been fully extended into the stacker as shown in FIG. 2 and after the carton $C_1$ has been lowered away from the lower tape surface 52*d*, a ream jogger means J engages the leading edge of the pile P and moves the pile P into abutment with the back sidewall 8 of the carton $C_1$. The jogger means J is situated beneath the divider means D and formed with an abutment head 61 having a planar surface facing the stacker 30. The head 61 is fixed upon the rightward end of a laterally reciprocal bar 62. The bar 62 is supported for lateral movement by means of bearing guides 63 mounted adjacent the rightward end of the bar 62. The left end of the bar 62 is formed with rack teeth 64 which engage a reversible pinion 65. The pinion 65 is to be driven in a back and forth motion when actuated. The pinion 65 may be driven in any known manner in response to movement of the divider means D. The pinion 65 drives the rack bar 62 first rightward such that head 61 shifts the ream P against the back sidewall 8, then back leftward to withdraw head 61 from the stacker 30.

After operation of the ream jogger J has been effected, the carton $C_1$ moves progressively downward on its descending support means 41 toward a discharge conveyor belt system 21. The discharge conveyor 21 is formed with a series of spaced-apart ribbon belts positioned so as to intermesh with the column support members 41 carrying carton $C_1$. The lift table 40 completes its descent when the top of the support means 41 dips just below the upper surfaces of the discharge conveyor ribbons 21. In this manner, the cartons $C_1$ is transferred to the discharge conveyor 21 to be borne away for final processing and lidding as shown in FIG. 3.

Before or while carton $C_1$ is descending from the ream jogger J to the discharge conveyor 21, a new carton $C_1'$ is deposited in a carton loading station L. Further carton $C_1'$ is identical to carton $C_1$ and may be loaded into the station L by a sheeter operator or by some sort of mechanical arrangement, since the instant invention is not limited to any particular loading means. As illustrated here, a truck means T moves back and forth along a track 81 formed in the loading station L as shown in FIGS. 1, 2, and 3 to convey the new carton $C_1'$ into the stacker 30. Alternate devices, such as a conveyor belt system, could also be used to convey further cartons. The track 81 is formed between platform wall portions 82 which serve to support the new carton $C_1'$ at its bottom side edges. The interior bottom surfaces of the new carton $C_1'$ are supported upon a series of spaced-apart fingers 73 formed on the truck T. A vertical wall 74 formed in the truck T engages the back sidewall, or trailing edge, 8' of the carton $C_1'$ and serves to push the carton $C_1'$ toward the stacker 30. The support fingers 73 extend from a platform member 75 located on the other side of the wall 74 from the fingers 73. Guide rollers 76 are mounted upon shafts extending through the platform portions 75 of the truck T and travel within the track 81.

One skilled in the art will readily appreciate that the truck T could be laterally propelled along the loading station L in any of a number of fashions. For example, the truck T could be secured to a link of an endless chain wrapped around two sprockets spaced apart at opposed ends of the loading station L. One sprocket could be driven in a reversibly rotatable manner so as to convey the truck T back and forth along the track 81 on the basis of control signals generated in response to positions of travel reached by support means 41 or lift table 40.

Figure 4:
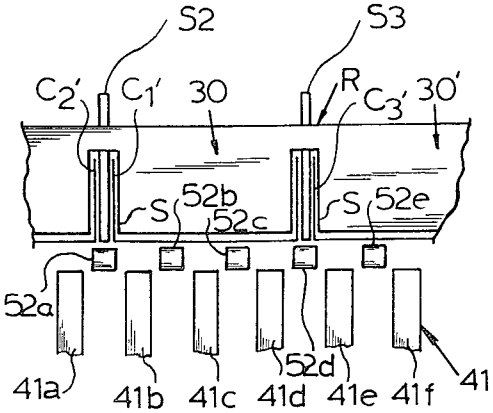
FIG. 4 is a partly schematic end elevation taken along the lines IV—IV of FIG. 1 when the cartoning assembly of the present invention is in a fourth stage of operation.

The track 81 is positioned in the loading station L such that the fingers 73 fit beneath the backstop R. As truck T is propelled further leftward, the bottom of carton $C_1'$ passes beneath the backstop R and is loaded into the stacker 30 as shown in FIG. 3. The backstop R is formed with slots S to accommodate the insertion of the sidewalls of the carton $C_1'$ as illustrated in FIG. 4. The folded under leading edge 7' of the carton $C_1'$ enters the stacker 30 along the gap G, such that the bottom of the carton $C_1'$ rests between lower tape surface 53*b* of the upper spear member 51 and upper tape surface 53*c* of the lower spear member 52. The spaced-apart fingers 73 formed on the truck T intermesh with the spaced-apart lower spear members 52 in the stacker 30. In this manner, the truck means T is able to deliver the further carton $C_1'$ fully into the stacker 30 until the back sidewall 8' is in abutment with the backstop R.

The upper tape surfaces 53*c* are located just above the truck fingers 73, such that, as the carton $C_1'$ is inserted into the stacker 30, the lower spear members 52 serve to carry or suspend the further carton $C_1'$ in the stacker 30. The truck T reverses its movement and withdraws from the stacker 30 for reloading when the carton $C_1'$ is fully inserted into the stacker 30. At this stage of operation of the cartoning assembly 100, the carton $C_1'$ is totally supported in the stacker 30 upon the lower spear members 52, such as 52*b*, 52*c* and 52*d*, as shown in FIG. 4, to receive the succeeding sheet accumulation P'.

By the time the truck T has totally withdrawn from the stacker 30, carton $C_1$ has been transported away from the stacker 30 on the discharge conveyor means 21 and lift table 40 has begun ascending towards a further carton $C_1'$ in the stacker 30. As shown in FIG. 4, the carton support column 41 intermesh with the lower spear means 52 in spaces recently vacated by the truck fingers 73. The support columns 41 are returned upward until respective columns, 41*b*, 41*c*, and 41*d*, engage the bottom of the carton $C_1'$ and lift carton $C_1'$ slightly over and off the upper tape surface 53*c* of the lower spear 52. In this manner, the support means 41 has returned for a transfer of support of carton $C_1'$ in the stacker since the support means 41 take over support of the carton from the spear support means 52. At this point, when the load of the carton $C_1'$ is taken off the lower spear means 52, the divider means D is withdrawn leftward from the stacker 30 toward its original position as shown in FIG. 1. With the withdrawal of the upper spear means 51, the succeeding sheet accumulation P' passes smoothly off the upper tape surface 53*a* and deposits into the carton $C_1'$, since the tape surfaces of the spear means 51 and 52 afford zero speed contact. Likewise, the carton $C_1'$ is not shifted on support column means 41 as the lower tape surface 53*b* withdraws over the bottom of the carton $C_1'$. The cartoning assembly is returned to its original position as shown in FIG. 1 in which sheets 10 continue to pile into the carton until a ream number has accumulated and the cartoning operation repeats.

The various stages of operation of the cartoning assembly 100 are performed in a sequence triggered by the relative positions of the cartoning assembly members. Many different means by which triggering signals could be generated and transmitted to the drive means for the moving members of the cartoning assembly, such as the truck T or the reversible pinions 55 and 56, will be readily apparent to those skilled in the art and form no basis for the present invention. As a matter of example, a trip pin may be affixed along one member, such as the divider means D, to activate an electric switch when this member reaches a particular position along its path of movement, such as full insertion of the divider D into the stacker 30. The electric switch may serve to actuate an electric motor drive for some other member, such as the loading truck T. The other member may likewise carry a trip pin to activate a further electric switch controlling another step in the cartoning assembly operation, and so on. For instance, a pin affixed to the truck T could trigger a switch causing the truck drive to reverse after the truck T has fully inserted a further carton, such as C', into the stacker 30.

It is contemplated that the present invention may be adapted to operate in a plurality of stacker stations at one time. The cartoning process would take place simultaneously in serially arranged stacker stations, such as 30 and 30' shown in FIG. 4. The stations are arranged along a continuous backstop wall R and bounded on the sides by separation, or partition, walls, such as $S_2$, and $S_3$, which serve to guide cartons being loaded into the stackers. Those skilled in the art will readily appreciate that the various stackers may be set up to utilize cartons, such as $C_1'$, $C_2'$, and $C_3'$, of different sizes. In order to provide simultaneous operation among the various cartoning assemblies, carton assembly members could be formed into long rows transgressing the various stacker stations. So, for example, lower spear means 52 would include spears 52*a* through *e*, of which 52*b* through *d* support carton $C_1'$ in stacker 30. Column support means 41 would include a row of columns 41*a* through *f*, of which 41 through d would be utilized to support carton $C_1'$ in stacker 30. The remaining spears and support columns would be simultaneously utilized in adjacent stations, such as 30'.

Although various minor modifications may be suggested by those versed in the art, it should be understood that I wish to embody within the scope of the patent warranted hereon all such modifications as reasonably and properly come within the scope of my contribution to the art.

I claim as my invention:

1. A method of cartoning sheet piles in a stacker, said method comprising:

continuously delivering and piling sheets seriatim in a stacker, loading a carton having an open top into said stacker to receive sheets therein, suspending said carton in said stacker on a first support means, transferring support of said carton in said stacker from said first support means to a second support means, withdrawing said first support means from said stacker, and transporting said carton on said second support means from said stacker for discharge after a predetermined sheet pile has accumulated in said carton.

2. The method according to claim 1, further comprising:

transferring said carton having said sheet pile from said second support means to a discharge conveyor.

3. The method according to claim 1, further comprising:

supporting an accumulation of sheets in said stacker on a third support means and withdrawing said third support means from said stacker simultaneously with the withdrawal of said first support means.

4. The method of claim 3, further comprising:

depositing said accumulation of sheets into said carton upon withdrawal of said third support means and piling sheets directly on top of said accumulation to form said sheet pile in said carton.

5. The method of claim 1, further comprising:

jogging said sheet pile in said carton after said sheet pile has accumulated.

6. An apparatus for the continuous cartoning of sheets in a stacker, said apparatus comprising stacker means in which sheets are piled, means for continuously delivering sheets seriatim into said stacker and piling said sheets in said stacker, and a cartoning assembly enabling sheets to pile directly in a carton in said stacker; said cartoning assembly comprising:

means for loading said carton into said stacker to receive sheets therein, first support means for suspending said carton in said stacker and mounted for withdrawal from said stacker, and second support means for taking over support of said carton from said first support means in said stacker and for transporting said carton from said stacker for discharge after a predetermined sheet pile has accumulated in said carton.

7. The apparatus according to claim 6, said cartoning assembly further comprising:

third support means for supporting an accumulation of sheets in said stacker and mounted for withdrawal from said stacker simultaneous with withdrawal of said first support means to deposit said accumulation of sheets into said carton such that succeeding sheets pile on top of said accumulation of sheets to form said sheet pile.

8. The apparatus according to claim 7, wherein said third support means includes an interrupter means for creating a cleft between the top of said sheet pile and the next succeeding sheet piled in said stacker.

9. The apparatus according to claim 7, wherein said first and second support means comprise respective lower and upper spear assemblies separated by a gap formed to receive a bottom wall of said carton therein, said spear assemblies being integral and laterally movable into and out of said stacker in unison.

10. The apparatus according to claim 6, said cartoning assembly further comprising:

means for jogging said sheet pile in said carton.

11. The apparatus according to claim 9, wherein said spear assemblies each include upper and lower continuous lengths of tape, each of which extend in an elongated loop.

12. The apparatus according to claim 9, wherein said lower spear assembly serves to compact said sheet pile in said carton when said spear assemblies are inserted into said stacker.

13. The apparatus according to claim 6, wherein said stacker includes a backstop means against which sheets jog for piling, said backstop having slots, said backstop slots formed such that carton sidewalls pass through said slots as said carton is loaded into said stacker and said backstop positioned such that the bottom of said carton passes beneath said backstop as said carton is loaded into said stacker until the backwall of said carton abuts said backstop.

14. The apparatus according to claim 13, said cartoning assembly further comprising:

means for jogging said sheet pile in said carton against said backwall of said carton, as said carton is being transported from said stacker.

15. The apparatus according to claim 6, said cartoning assembly further comprising:

discharge conveyor means for unloading said carton containing said sheet pile from said second support means.

16. An apparatus for the continuous cartoning of sheets in a stacker, comprising:

a stacker means in which sheets are piled, means for continuously delivering sheets seriatim into said stacker and piling said sheets in said stacker, first support means for supporting a succeeding accumulation of sheets in said stacker after a predetermined pile has formed in said stacker, means for loading cartons seriatim into said stacker to contain corresponding said predetermined piles, second support means for supporting each said carton respectively in said stacker such that sheets being delivered and piled in said stacker accumulate in said respective carton and for transporting each said filled carton from said stacker after a corresponding predetermined pile has accumulated in said respective carton, third support means for carrying each corresponding succeeding unfilled carton beneath said corresponding accumulation of sheets in said stacker as each said filled carton is being transported from said stacker, and means for removing said first and third support means from said stacker such that said corresponding accumulation of sheets passes into said respective unfilled carton and said respective unfilled carton is transferred onto said second support means.

17. The apparatus according to claim 16, wherein said third support means comprises a spear assembly, mounted for lateral movement into and out of said stacker and including a carrying surface formed by a continuous length of tape.

18. The apparatus according to claim 16, further comprising means for jogging each said predetermined pile in each respective filled carton.

* * * * *